US005292265A

United States Patent [19]

Chen et al.

[11] Patent Number: 5,292,265

[45] Date of Patent: Mar. 8, 1994

[54] EDGE MOUNTED CIRCUIT BOARD ELECTRICAL CONNECTOR

[75] Inventors: Yu-Wen Chen, Taipei, Taiwan; Nai K. Wong, Singapore, Singapore

[73] Assignee: Molex Incorporated, Lisle, Ill.

[21] Appl. No.: 25,199

[22] Filed: Mar. 2, 1993

[51] Int. Cl.[5] ..... H01R 4/02

[52] U.S. Cl. ..... 439/876; 439/326

[58] Field of Search ..... 29/843, 860, 863; 439/874–876, 630–637, 326–328

[56] References Cited

U.S. PATENT DOCUMENTS

| | | | |
|---|---|---|---|
| 3,589,591 | 6/1971 | Schivenn | 29/843 |
| 3,953,102 | 4/1976 | Rivetta et al. | 439/876 |
| 4,548,456 | 10/1985 | Robertson | 339/75 MP |
| 4,592,617 | 6/1986 | Seidler | 439/876 |
| 4,737,115 | 4/1988 | Seidler | 439/876 |
| 4,957,448 | 9/1990 | Stanevich et al. | 439/326 |
| 5,009,611 | 4/1991 | Regnier | 439/326 |
| 5,090,116 | 2/1992 | Hinchen et al. | 439/876 |
| 5,160,275 | 11/1992 | Nakamura et al. | 439/328 |
| 5,210,937 | 5/1993 | Delamoreaux | 439/876 |

FOREIGN PATENT DOCUMENTS

| | | | |
|---|---|---|---|
| 0405333A3 | 1/1991 | European Pat. Off. | H01R 13/193 |
| 2242579A | 10/1991 | United Kingdom | H01R 13/71 |

*Primary Examiner*—David L. Pirlot
*Attorney, Agent, or Firm*—Charles S. Cohen

[57] ABSTRACT

An electrical connector is provided for surface mounting along an edge of a circuit board in an edge straddling configuration. The circuit board has a plurality of contact pads spaced along opposite faces of the board near the edge thereof. The connector includes a dielectric housing and a plurality of terminals mounted on the housing with solder tails projecting from the housing generally in two rows to define an elongate board-receiving mouth for receiving the edge of the circuit board. The contact pads are adapted to receive soft solder paste thereon prior to insertion of the board into the mouth between the two rows of solder tails. The solder tails of the terminals are configured for receiving the circuit board at a first angular orientation wherein minimal contact force is effected between the solder tails and the contact pads to prevent any substantial wiping away of the solder paste from the contact pads and a second angular orientation wherein substantial contact force is effected between the solder tails and the contact pads in a direction generally normal to the faces of the circuit board. Therefore, the solder paste remains in an interface area at each contact pad and its respective solder tail.

17 Claims, 5 Drawing Sheets

EDGE MOUNTED CIRCUIT BOARD ELECTRICAL CONNECTOR

FIELD OF THE INVENTION

This invention generally relates to the art of electrical connectors and, particularly, to a system for surface mounting an electrical connector assembly along an edge of a circuit board in an edge straddling configuration.

BACKGROUND OF THE INVENTION

There are a wide variety of electrical connectors adapted for surface mounting on a printed circuit board. Some such connectors are mounted to one side of the circuit board and include solder tails for surface mounting to contact pads on the side of the board or for insertion into holes in the circuit board for soldering to circuit traces interconnected to the holes. Other such connectors are adapted for mounting along an edge of the circuit board, with solder tails of the terminals engageable with contact pads on one or both sides of the board adjacent the edge. The latter type of connectors commonly are called "edge connectors" and, when the solder tails engage contacts on both sides of the board along the edge, the connectors commonly are called "straddle mount" connectors.

One of the problems encountered with straddle mount connectors is that soft solder paste or cream is removed from vital portions of the board contact pads if there is a sliding engagement between the tails and the pads during positioning of the board and the connector in such a straddle mount condition. In a straddle mount connector system, the board must be inserted in a slot or mouth defined between solder tails engageable with contact pads on both opposite sides of the board in a straddling configuration. Soft solder paste is applied to the contact pads on both sides of the board before the board is inserted into the connector. It is desirable to have a predetermined contact force between the solder tails and the board contact pads, in a direction normal to the board, to provide good electrical contact points. On the other hand, it is desirable to have zero or minimal forces between the solder tails and the contact pads while positioning the solder tails on the contact pads to prevent the soft solder paste from being wiped off of the contact pads which can result in defective solder interfaces or short circuiting between adjacent contact pads.

Various approaches have been made in the connector industry to solve the problems outlined above. For instance, in U.S. Pat. No. 5,160,275, dated Nov. 3, 1992, a straddle mount electrical connector is provided which will not cause removal of a cream solder that has been applied to the circuit board, and which will not flaw the surface of circuit portions on the board. The connector has a resilient arm which undergoes elastic deformation to flex contacts perpendicularly away from the surface of the circuit portions when the circuit board is inserted into the connector. The resilient arm is restored to its original shape when the connector has been correctly fitted on the circuit board, thereby allowing the contacts to contact predetermined circuits. In another embodiment, the resilient arm is replaced by a frame member which is urged into the connector body by the circuit board. This causes the contacts to part perpendicularly from the surface of the circuit portions.

Another example is disclosed in United Kingdom patent application No. 2 242 579 A, published Oct. 2, 1991, which includes latch arms at the ends of a connector housing extending in the same direction as the terminal pins or solder tails with molded protuberances at the outer ends of at least one of the latch arms, apparently to keep the board contact pads from touching the solder tails until the circuit board is fully inserted between the spaced latch members, when the terminal pins are electrically engaged with the contact pads. In the fully inserted position, the protuberances fit into openings in the board.

Most such approaches as described above involve additional expensive connector components, even components which are separate from the connector housing, or expensive integral devices between the connector housing and a specially designed board. This invention is directed to providing an extremely simple and cost effective solution to solving the problems outlined above.

SUMMARY OF THE INVENTION

An object, therefore, of the invention is to provide a new and improved system for surface mounting an electrical connector assembly along an edge of a circuit board in an edge straddling configuration, and which allows for mating of the connector and the board without substantially wiping away soft solder paste from contact pads on the board.

In the exemplary embodiment of the invention, an electrical connector is provided for surface mounting along an edge of a circuit board in an edge straddling configuration. The circuit board has a plurality of contact pads spaced along opposite faces of the board near the edge thereof. The connector includes a dielectric housing and a plurality of terminals mounted on the housing, with solder tails of the terminals projecting from the housing in two rows to define an elongate board-receiving mouth for receiving the edge of the circuit board.

The invention contemplates that the contact pads of the circuit board be adapted to receive soft solder paste thereon prior to insertion into the mouth between the two rows of solder tails. The solder tails are configured for receiving the circuit board at a first angular orientation wherein zero or minimal contact force is effected between the solder tails and the solder paste on the contact pads to prevent any substantial wiping away of the solder paste from the contact pads. When fully received, the circuit board is rotatable to a second angular orientation wherein the solder tails and the solder paste on the contact pads are in contact.

Latch means may be operatively associated between the connector housing and the circuit board for securing the circuit board against rotation from its second angular orientation. In an alternate embodiment of the invention, second latch means are operatively associated between the housing and the circuit board for securing the circuit board against pulling out of the mouth between the two rows of solder tails.

A further feature of the invention contemplates the provision of abutment means on the housing for engagement by the edge of the circuit board to define a fully inserted condition of the connector assembly and the circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
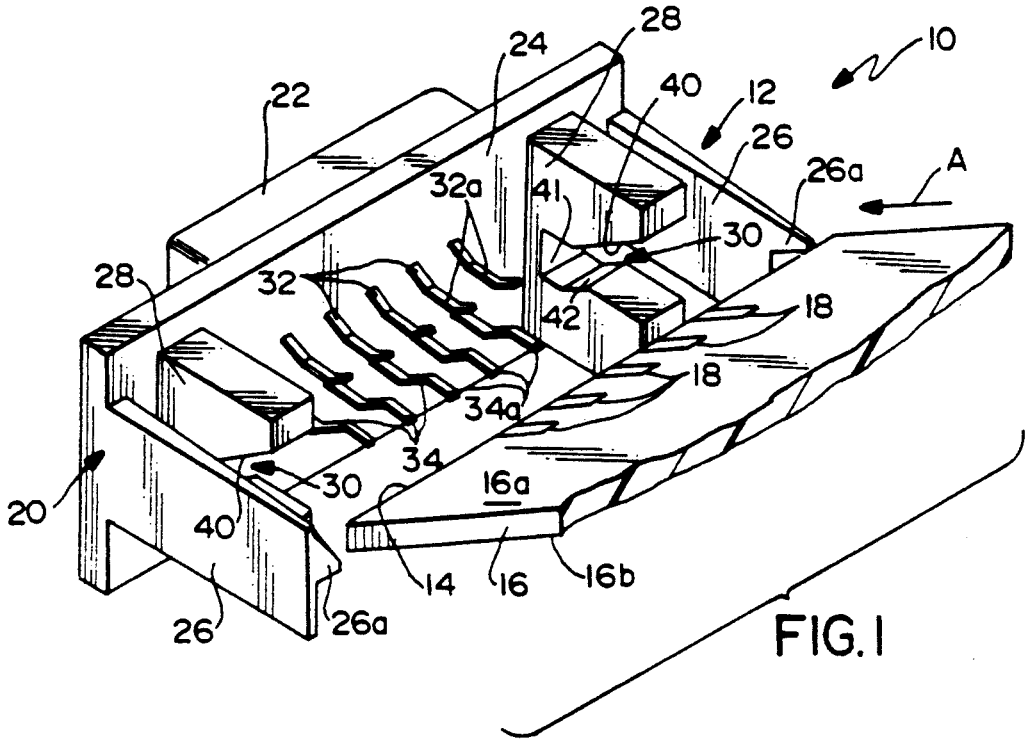
FIG. 1 is a perspective view of an electrical connector assembly embodying the concepts of the invention, in conjunction with a circuit board about to be inserted into the connector assembly.

Referring to the drawings in greater detail, and first to FIG. 1, the invention is embodied in a system, generally designated 10, for surface mounting an electrical connector assembly, generally designated 12, along an edge 14 of a circuit board 16 in an edge straddling configuration.

Circuit board 16 has first (top) and second (bottom) parallel, generally planar faces 16*a* and 16*b*, respectively. The top face has a first row of relatively spaced contact pads 18 immediately adjacent edge 14 of the board. Although not visible in FIG. 1, bottom face 16*b* of the board has a second row of relatively spaced contact pads which are spaced inwardly of the edge of the board, as will be seen more clearly hereinafter. The pads on opposite faces may be aligned or offset in a direction parallel to the edge 14 of the circuit board. The contact pads on the opposite faces of the circuit board are adapted for receiving soft solder paste 19 thereon prior to mating with or insertion into connector assembly 12.

At this point, it should be understood that such terms as "top", "bottom", "upper", "lower", etc. are being used herein and possibly in the claims hereof in order to provide a clear and concise description of the invention in relation to the depictions in the drawings. However, such terms are understood as not being limiting in any fashion, it being understood that the system of the invention is omni-directional in use and applications as is well known in the electrical connector art. In addition, while only five contact pads 18 are shown on top surface 16*a* of the circuit board (along with a similar number of contact pads on the opposite side of the board and a similar number of terminals on connector assembly 12, as described hereinafter), the invention is equally applicable and has distinct advantages in high density electrical connectors having significant numbers of contact pads and terminals in a straddle mount configuration.

Connector assembly 12 includes a unitarily molded dielectric housing, generally designated 20, which includes a front mating end 22 and a rear straddle mount face 24. The front mating end can be of a variety of configurations for mating with an appropriate complementary connector (not shown). A pair of integral, flexible latch arms 26 project rearwardly of housing 20 at opposite ends thereof. Each latch arm has an inwardly directed latch hook 26*a* for latching engagement with circuit board 16 when the board is mated with the connector assembly, as described hereinafter. A pair of board positioning and guiding blocks 28 project rearwardly from straddle mount face 24 of housing 20, spaced inwardly of latch arms 26. Generally, blocks 28 define slots, as at 30, for receiving edge 14 of circuit board 16.

A plurality of terminals are mounted in housing 20. The terminals include mating portions (not shown) projecting into mating portion 22 of the housing for interconnection with mating terminals of the complementary connector. Generally, the terminals are mounted in the housing in an array to present two rows of solder tail portions of the terminals projecting rearwardly of straddle mount face 24 of the housing. More particularly, a first (top) row of solder tails 32 are shown in FIG. 1 spaced above a second (bottom) row of solder tails 34 projecting from straddle mount face 24. The two rows of solder tails define a slot or an elongate board-receiving mouth 36 (FIG. 3A) for receiving edge 14 of circuit board 16. Such solder tails 32 and 34 are sufficiently resilient so as to compensate for any variations in the surface of the circuit board which can result in the solder tails not being coplanar with the surfaces of the circuit board.

Figure 2:
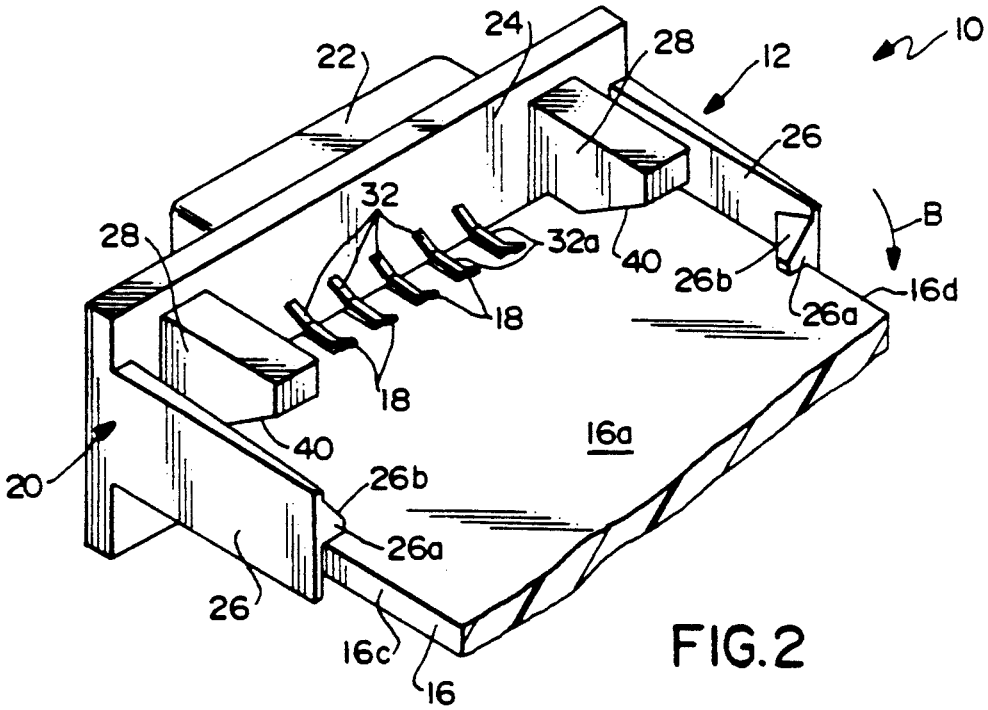
FIG. 2 is a view similar to that of FIG. 1, showing the circuit board in its fully inserted condition with the connector assembly in a straddle mount configuration.
Figure 3A:
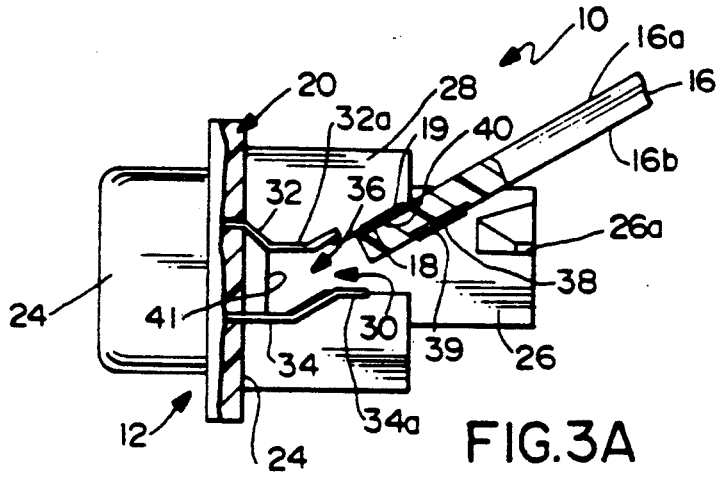
FIGS. 3A-3C are end elevational views, partially broken away, showing the sequence of inserting the circuit board into the connector assembly.
Figure 3B:
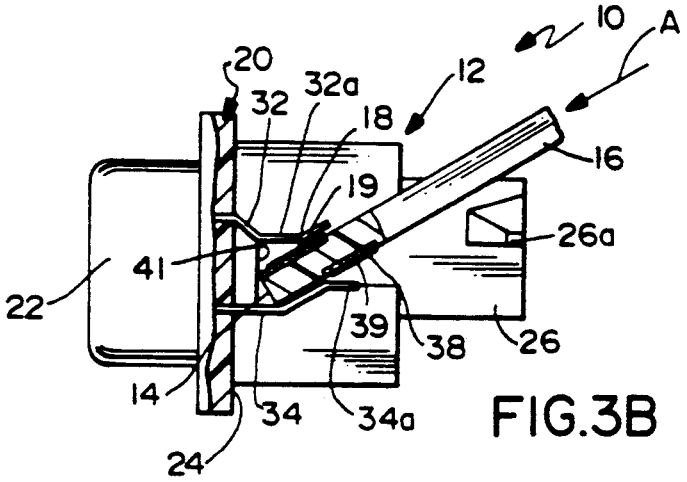
Figure 3C:
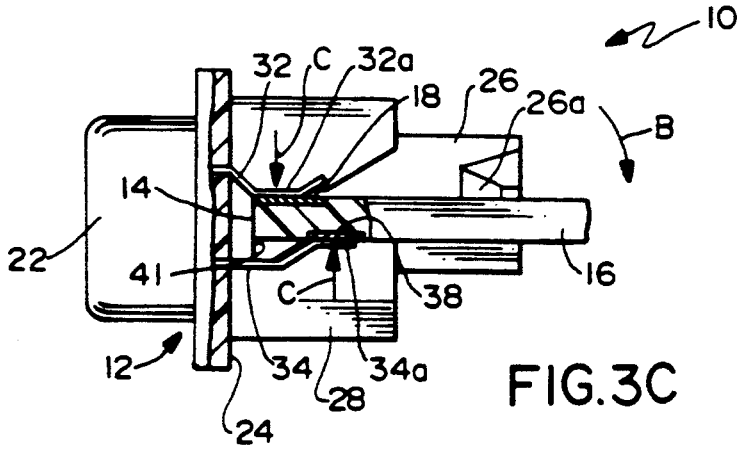
Figure 4:
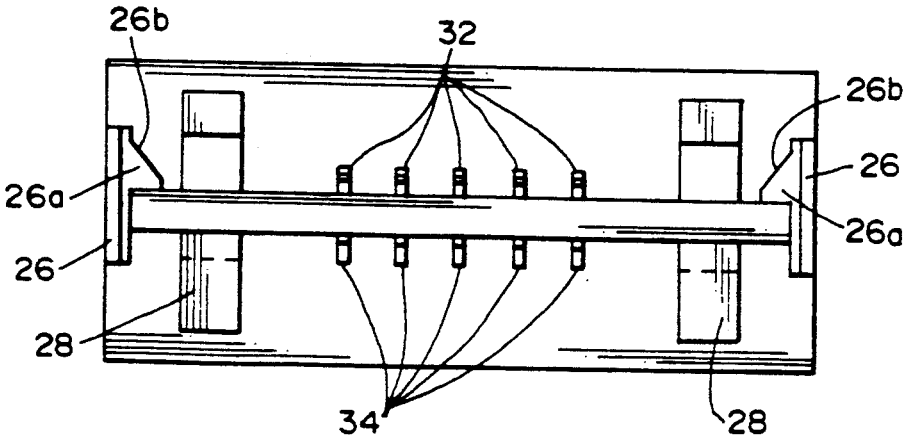
FIG. 4 is an elevational view looking toward the right-hand end of FIG. 2 or FIG. 3C.

Before proceeding to a more detailed description of the invention as best depicted in FIGS. 3A-3C, a comparison between FIGS. 1 and 2 should be made. It can be seen in FIG. I that circuit board 16 is canted or angled relative to connector assembly 12. This defines a first angular orientation of insertion of the board into slots 30 of positioning and guiding blocks 28 and the elongate mouth 36 defined between the two rows of solder tails 32 and 34. The circuit board is inserted generally in the direction of arrow "A" in FIGS. 1 and 3B. Once the circuit board is fully inserted into the connector assembly, the circuit board is rotated downwardly in the direction of arrow "B" (FIG. 2) to a second angular orientation relative to the connector assembly. This second angular orientation is shown in FIG. 2, as well as in FIG. 4. In the second angular orientation, latch hooks 26*a* of flexible latch arms 26 snap over the top face 16*a* of the circuit board for securing the board against rotation from its second angular orientation. It can be seen that top surfaces 26*b* of the latch hooks are angled to provide camming surfaces for engagement by the side edges of the circuit board to bias latch arms 26 outwardly until hooks 26*a* snap against the top surface of the circuit board.

Reference now is made to the sequential views of FIGS. 3A-3C which show the sequence of insertion of circuit board 16 into connector assembly 12, and particularly into slots 30 of board positioning and guiding blocks 28, as well as into the elongate board-receiving mouth 36 (FIG. 3A) between the upper row of terminals 32 and the lower row of terminals 34.

Before proceeding with a description of the insertion sequence, there are certain details visible in FIGS. 3A-3C which are not visible in FIGS. 1 and 2. First, it can be seen that a second row of contact pads 38 are on bottom face 16b of circuit board 16. Like contact pads 18 on top face 16a of the circuit board, the bottom contact pads are relatively spaced in a row generally parallel to the edge of the board. However, it should be noted that, whereas the row of contact pads 18 are adjacent the edge of the board, contact pads 38 are spaced inwardly of the edge of the board.

Second, slots 30 in positioning and guiding blocks 28 are defined by upper and lower angled surfaces 40 and 42 (FIG. 1), respectively. The distance between angled surfaces 40 and 42 (i.e., the width of slots 30) is slightly less than the width of mouth 36 between the terminals. Therefore, as the board is inserted into the slot/mouth configuration in its first angular orientation (FIGS. 1 and 3A), the contact pads on the board, along with most of the solder paste on the contact pads, cannot engage the terminals which, otherwise, would result in substantial wiping away of the solder paste.

Third, each of the terminals 32 in the upper row thereof includes a contact portion 32a, and each of the terminals 34 in the lower row thereof includes a contact portion 34a. It can be seen that these contact portions are generally planar, vertically spaced and horizontally parallel, with contact portions 32a of the upper row of terminals 32 being located nearer to straddle mount face 24 of housing 12 than contact portions 34a of the lower row of terminals 34.

With the above specifics, reference now is made to FIG. 3A, wherein it can be seen that circuit board 16 is in its first angular orientation and about to be inserted into slots 30 in positioning and aligning blocks 28 and into mouth 36 between the upper and lower rows of terminals 32 and 34, respectively. It can be seen that upper angled surface 40 of block 28, which defines the top of each slot 30, is generally parallel to this first angular orientation of the board. The same is true for the lower angled surface 42 (FIG. 1) which defines the bottom of the slot in each positioning and aligning block.

Referring next to FIG. 3B, circuit board 16 is inserted into slot 30 and mouth 36 (FIG. 3A) in the direction of arrow "A" until the edge of the board engages abutment surfaces 41 of the positioning and aligning blocks 28. The board still is in its first angular orientation. However, it should be noted that the solder paste on upper contact pads 18 has not substantially engaged contact portions 32a of upper solder tails 32, and the solder paste 39 on lower contact pads 38 has not substantially engaged contact portions 34a of lower solder tails 34. Therefore, the solder paste which has been applied to contact pads 18 and 38 does not get wiped away from the contact pads during insertion of the circuit board into the connector assembly. This is due to the low or zero insertion force design of the connector assembly. In other words, the solder paste will not be wiped away so long as the solder paste is no thicker than a predetermined thickness. If the paste is thicker, only a certain amount will be wiped away leaving an amount equal to the predetermined thickness.

Lastly, referring to FIG. 3C, once the circuit board is fully inserted to the position shown in FIG. 3B, with edge 14 of the circuit board abutting against surfaces 41 of blocks 28, the circuit board is rotated downwardly in the direction of arrow "B" to its second angular orientation as described above in relation to FIG. 2. In this second angular orientation, it can be seen that solder paste on the upper contact pads 18 have been rotated or pivoted upwardly into engagement with contact portions 32a of upper solder tails 32, and solder paste on the lower contact pads 38 have been rotated or pivoted downwardly into engagement with contact portions 34a of solder tails 34. It also can be seen that circuit board 16 has been latched beneath latch hooks 26a of flexible latch arms 26. Since the solder paste has not been wiped from the contact pads, the solder paste remains in interface areas at and immediately about each contact pad and its respective solder tail.

Figure 7:
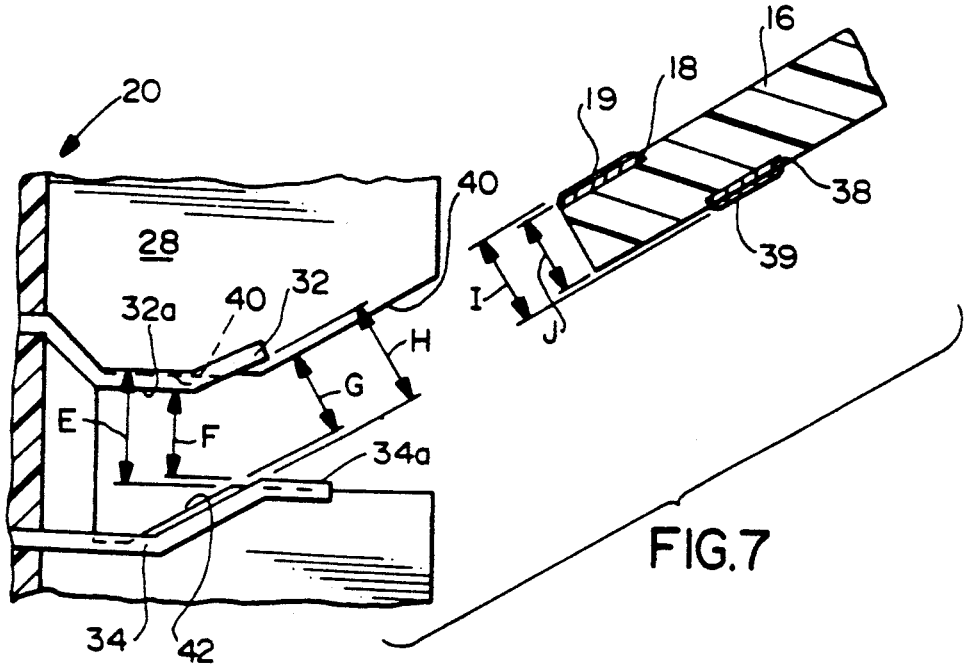
FIG. 7 is an enlarged fragmented and elevational view similar to FIG. 3A.

Referring to FIG. 7, the critical size relationship can be seen. For example, the distance between upper angled surface 40 and lower angled surface 42, designated by arrow "G", is smaller than the distance between those portions of the terminal 32 and 34, designated by arrow "H", in the same direction. The thickness of a printed circuit board 16 is designated by arrow "J" and the minimum thickness from an acceptable amount of solder paste 19 on contact pad 18 to the solder paste 39 on contact pad 18 to the solder past 39 on contact pad 38 is designated by arrow "I". Since upper and lower angled surfaces 40 and 42 contact a portion of the circuit board adjacent the edges (FIG. 2) 16c and 16d of the board 16 and not the contact pads having solder paste thereon, distance "G" is equal to or greater than distance "J". In order to prevent the solder paste from being wiped off the respective contact pads, distance "H" is greater than or equal to distance "I". Once circuit board 16 is rotated to its second orientation, as shown in FIG. 3c, the contact portions 32a and 34a of the terminals must contact the solder paste. Accordingly, distance "F" must be less than distance "I" and is preferably greater than distance "J".

FIGS. 5 and 6A-6C show an alternate embodiment of the invention which, generally, includes second latch means operatively associated between the connector assembly housing and the circuit board for securing the circuit board against pulling out of the connector assembly, i.e., out of the mouth between the two rows of solder tails 32 and 34. In addition, the second latch could be part of ground circuitry. Otherwise, the electrical connector and the circuit board are substantially identical to that described above and shown in FIGS. 1-4, and like reference numerals have been applied to indicate like components in relation to those figures.

Figure 5:
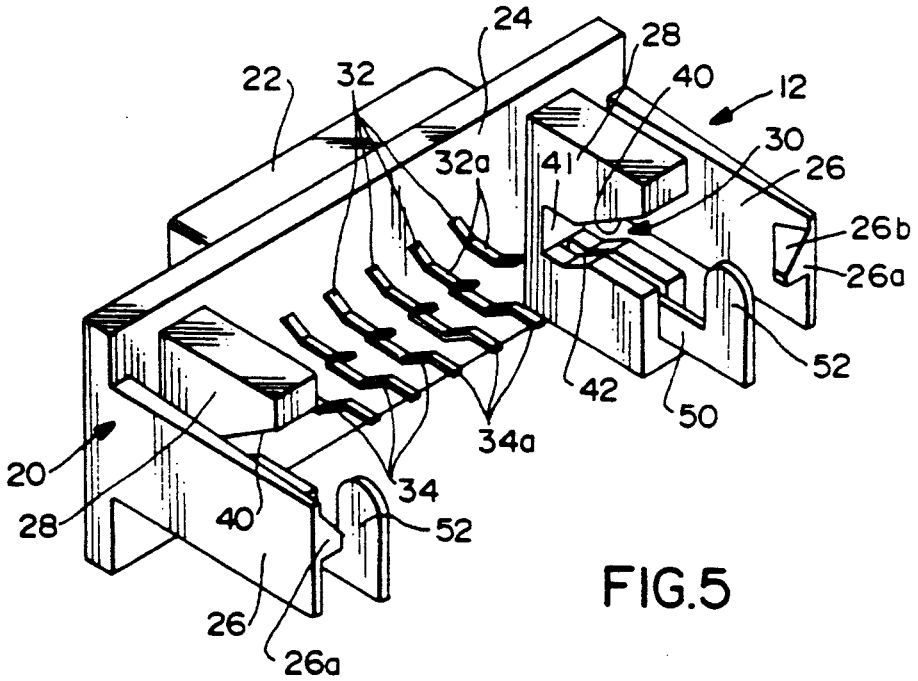
FIG. 5 is a perspective view of a connector assembly embodying an alternative form of latch means.
Figure 6A:
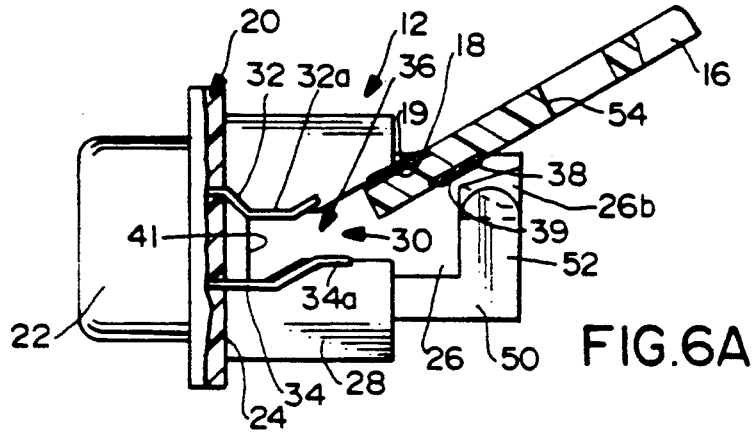
FIGS. 6A-6C are sequential views similar to FIGS. 3A-3C, but of the alternate embodiment of the invention shown in FIG. 5.
Figure 6B:
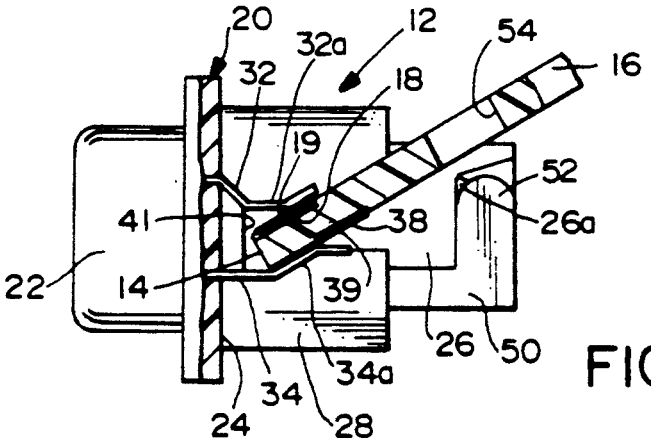
Figure 6C:
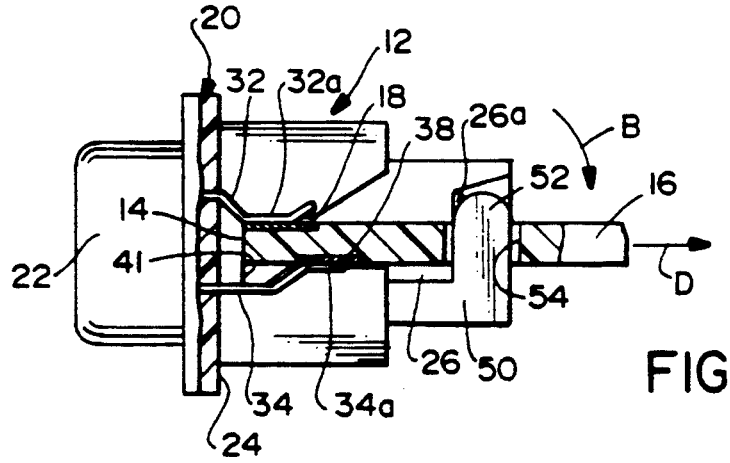

More particularly, referring first to FIG. 5, a pair of second latch arms 50 project outwardly or rearwardly from the bottom of board positioning and aligning blocks 28. The latch arms have upwardly projecting latch tongues 52. Referring to FIGS. 6A-6C, circuit board 16 has a pair of openings or holes 54 for receiving latch tongues 52.

When the circuit board shown in FIGS. 6A-6C is inserted into connector assembly 12 as described above in relation to FIGS. 3A-3C, and the circuit board is moved from its first angular orientation (FIG. 6B) to its second angular orientation (FIG. 6C), in the direction of arrow "B", latch tongues 52 move into holes 54 in the circuit board and prevent the circuit board from being pulled out of the connector assembly in the direction of arrow "D" (FIG. 6C). Therefore, the combination of latch hooks 26a and latch tongues 52 secure the circuit board against rotation from its second angular orientation and also secures the circuit board against pulling out of the mouth between the two rows of solder tails and out of the connector assembly. In addition, the interengagement between the tongues 52 and holes 54 also serves to properly align, in a direction parallel to the longitudinal axis of the mouth 36, the terminals with their respective contact pads.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for surface mount soldering along opposite faces of an edge of a circuit board in a straddle mount configuration, said connector being adapted to permit the application of solder paste to contact pads on opposite faces of the circuit board prior to positioning the circuit board in said straddle mount configuration and subsequently positioning the circuit board in the straddle mount configuration without substantially wiping away the solder paste from the contact pads, said contact pads being adapted to receive solder paste thereon;

said circuit board having a pair of parallel, generally planar faces, each face including a plurality of contact pads positioned thereon in a row along and generally parallel to said edge;

said connector having a dielectric housing including a straddle mount face for receiving the edge of the circuit board thereat;

a plurality of terminals mounted in said housing with a solder tail of each terminal being positioned adjacent said straddle mount face for permanent soldering to a respective one of said contact pads when said circuit board is positioned at said straddle mount face in a straddle mount configuration, said solder tails being positioned in first and second parallel rows to define a slot therebetween, each row being generally aligned with a longitudinal axis of said connector, the housing and the terminals being configured to receive the edge of the circuit board in said slot without substantially wiping away solder paste applied to said contact pads prior to insertion of said edge into said slot;

wherein the improvement comprises:

the housing and the solder tails of the terminals being configured so that the edge of said circuit board can be inserted at a first angular orientation relative to the housing with zero contact force between the solder tails and the contact pads, said housing and terminals being adapted to permit the circuit board to be rotated to a second angular orientation relative to the housing wherein said solder tails contact solder paste applied to their respective contact pads on the circuit board;

whereby solder paste can be applied to the contact pads of the circuit board prior to insertion thereof into said slot, said edge of the circuit board can be inserted into said slot between the first and second rows of solder tails at said first angular orientation without substantially wiping away said solder paste from said contact pads, and said circuit board can be rotated to its second angular orientation whereat it is secured in order to permit soldering of said solder tails to their respective contact pads.

2. The electrical connector of claim 1 wherein each solder tail of said first row of solder tails has a solder area for soldering to the contact pads on one of said faces of the circuit board, each solder tail of said second row of solder tails has a solder area for soldering to the contact pads on the other of said faces of the circuit board, and the solder areas of said first row of solder tails is offset from the solder areas of said second row of solder tails in a direction away from said straddle mount face parallel to the plane of the circuit board when said circuit board is in its second angular orientation.

3. The electrical connector of claim 1 further comprising guides on said housing for defining said first angular orientation.

4. The electrical connector of claim 3 wherein said housing includes first and second oppositely facing guide surfaces adjacent each end of said straddle mount face for defining said first angular orientation.

5. The electrical connector of claim 3 wherein said guide include first and second oppositely facing guide surfaces.

6. The electrical connector of claim 5 wherein the plane defined by said first guide surface is adjacent said first row of solder tails and the plane defined by said second guide surface is adjacent said second row of solder tails, said first row of solder tails being positioned relative to said first guide surface to prevent the solder paste applied to said solder pads adjacent said first row of solder tails from being substantially wiped away as said circuit board is inserted into said slot in said first orientation.

7. The electrical connector of claim i further including latch means for securing the circuit board at said second angular orientation.

8. The electrical connector of claim 7 further including first and second oppositely facing guide surfaces for defining said first angular orientation.

9. A method for surface mount soldering an electrical connector along opposite faces of an edge of a circuit board in a straddle mount configuration by applying the solder paste to contact pads of the circuit board prior to positioning the circuit board in said straddle mount configuration and subsequently positioning the circuit board in the straddle mount configuration without substantially wiping away the solder paste from the contact pads, comprising the steps of:

providing a circuit board having a pair of parallel, generally planar faces, each face including a plurality of contact pads positioned thereon in a row along and generally parallel to said edge;

applying solder paste to said contact pads of said circuit board;

providing an electrical connector having a dielectric housing including a straddle mount face for receiving the edge of the circuit board thereat, and a plurality of terminals mounted in said housing with a solder tail of each terminal being positioned adjacent said straddle mount face for permanent soldering to a respective one of said contact pads when said circuit board is positioned at said straddle mount face in a straddle mount configuration, said solder tails being positioned in first and second parallel rows to define a slot therebetween, each row being generally aligned with a longitudinal axis of said connector, the housing and the terminals being configured to receive the edge of the circuit board in said slot at a first angular orientation relative to the housing with zero contact force between the solder tails and the contact pads, and to permit the circuit board to be rotated to a second angular orientation relative to the housing wherein said solder tails contact solder paste applied to their respective contact pads on the circuit board;

inserting said circuit board into said slot at said first angular orientation relative to the housing with zero contact force between the solder tails and the contact pads;

rotating the circuit board to a second angular orientation relative to the housing wherein said solder tails contact solder paste applied to their respective contact pads on the circuit board; and securing said circuit board at said second angular orientation; and applying thermal energy to reflow the solder paste on said contact pads in order to solder said solder tails to said contact pads.

10. The method of claim 9 further including providing a mouth, remote from said contact pads, configured to allow the circuit board to move between said first and second orientations, said mouth having a first surface for guiding the board in its first orientation and being narrower than the slot between solder tails in a direction parallel to said first orientation, and sliding said circuit card along said first surface in said first orientation to insert said circuit card into said slot.

11. In an electric connector for surface mount soldering along opposite faces of an edge of a circuit board in an edge straddling configuration, the circuit board having a plurality of contact pads spaced along opposite faces of the board near the edge thereof, the connector including a dielectric housing and a plurality of terminals mounted on the housing with solder tails aligned generally in two rows to define an elongate board-receiving mouth for receiving the edge of the circuit board, wherein the improvement comprises:

said contact pads being adapted to receive solder paste thereon prior to insertion of the board into the mouth between the two rows of solder tails, and the solder tails of said terminals being configured for receiving the circuit board at a first angular orientation wherein minimal contact force is effected between the solder tails and the solder paste applied to the contact pads to prevent substantial wiping away of the solder paste from the contact pads and a second angular orientation wherein the solder tails are positioned adjacent their respective contact pads and the solder paste remains in an interface area at each contact pad and its respective solder tail.

12. The system of claim 11, including latch means operatively associated between the housing and the circuit board for securing the circuit board against pulling out of said mouth between the two rows of solder tails.

13. The system of claim 11, including abutment means on the housing for engagement by the edge of the circuit board to define a fully mated condition of the connector assembly and the circuit board.

14. The system of claim 11, wherein the housing includes slot means for receiving the edge of the board, remote from the contact pads on the board, the slot means being configured to allow for movement of the board between said orientations, and the slot means further having a first portion for guiding the board in its first orientation, said first portion being narrower than the board-receiving mouth between the solder tails in a direction parallel to said first orientation.

15. The system of claim 11, including latch means operatively associated between the connector housing and the circuit board for securing the circuit board against rotation from said second angular orientation.

16. The system of claim 15, including second latch means operatively associated between the housing and the circuit board for securing the circuit board against pulling out of said mouth between the two rows of solder tails.

17. The system of claim 15 further including first and second oppositely facing guide surfaces for defining said first angular orientation.

* * * * *

UNITED STATES PATENT AND TRADEMARK OFFICE

CERTIFICATE OF CORRECTION

PATENT NO. : 5,292,265
DATED : March 8, 1994
INVENTOR(S) : Yu-Wen Chen, et al.

It is certified that error appears in the above-indentified patent and that said Letters Patent is hereby corrected as shown below:

IN THE DRAWINGS

Figure 8A:
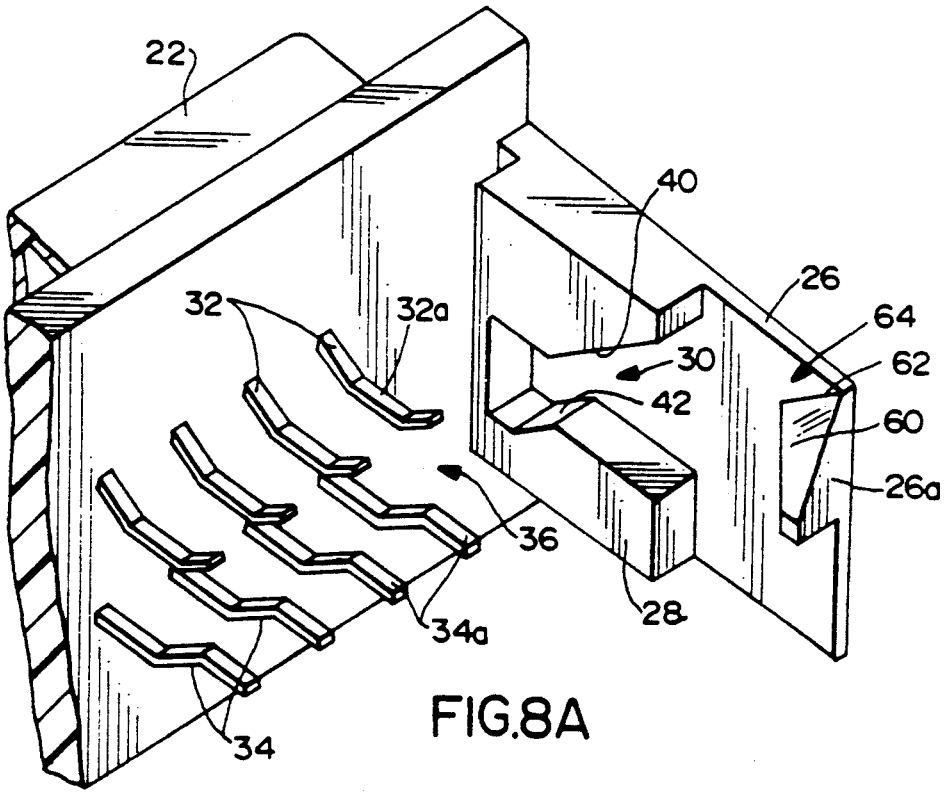
FIG. 8A is a cutaway view of FIG. 1.

Delete Figure 8A.

Column 3, line 30, delete "FIG. 8A is a cutaway view of FIG. 1."

Signed and Sealed this

Twenty-third Day of May, 1995

*Attest:*

*Attesting Officer*

BRUCE LEHMAN

*Commissioner of Patents and Trademarks*